United States Patent [19]

Fritsch et al.

[11] Patent Number: 4,671,588

[45] Date of Patent: Jun. 9, 1987

[54] FUSE PULLER FOR BARREL FUSE

[75] Inventors: Ronald J. Fritsch, Sussex; John E. Swedowski, Milwaukee, both of Wis.

[73] Assignee: Eaton Corporation, Cleveland, Ohio

[21] Appl. No.: 875,046

[22] Filed: Jun. 17, 1986

[51] Int. Cl.[4] ..... H01R 13/62

[52] U.S. Cl. ..... 439/160; 337/211; 439/832

[58] Field of Search ..... 339/45 R, 45 M, 252 F, 339/253 F, 258 F, 259 F, 262 F, 266 F; 337/196, 207, 211, 215, 245

[56] References Cited

U.S. PATENT DOCUMENTS

| | | | |
|---|---|---|---|
| 2,042,756 | 6/1936 | Wood | 337/245 |
| 2,984,723 | 5/1961 | Jacobs | 337/211 |
| 3,194,926 | 7/1965 | Ustin | 337/215 |
| 3,478,307 | 11/1969 | Testo | 339/258 F |
| 3,518,599 | 6/1970 | Lanux | 337/211 |
| 4,288,138 | 9/1981 | Berry et al. | 339/45 R |
| 4,429,936 | 2/1984 | Rusenko et al. | 339/45 R |

*Primary Examiner*—Gil Weidenfeld
*Assistant Examiner*—David Pirlot
*Attorney, Agent, or Firm*—D. A. Rowe; L. G. Vande Zande

[57] ABSTRACT

An L-shaped member (20) is secured adjacent a fuse clip (12) to extend forwardly along one side of a fuse (F) received in that fuse clip. A flexible insulating strap (24) is secured to the outer end of the forwardly projecting post (20*a*) to lie within a groove (20*e*) in the post and extend rearwardly around the back side of the fuse and then forwardly along an opposite lateral side of the fuse. Pulling the free end of the strap (24) upwardly or forwardly causes that end of the fuse to be rolled forwardly of the fuse clip with a mechanical advantage.

8 Claims, 4 Drawing Figures

FUSE PULLER FOR BARREL FUSE

BACKGROUND OF THE INVENTION

This invention relates to a fuse puller device for removing a fuse from its fuse clip terminals. More particularly, the invention relates to a device of the aforementioned type which is particularly useful for removing a barrel type fuse from its spring clip terminals. Still more specifically, this invention relates to a fuse puller of the aforementioned type wherein the overall dimension of the fuse puller in relation to the lateral, or transverse, plane of the fuse is minimized to enable use of the fuse puller in dimensionally restricted applications.

Fuse pullers are well known in the art. For example, U.S. Pat. No. 2,042,756 issued June 2, 1936 to M. B. Wood, shows a fuse puller for a barrel type fuse comprising a fexible strap having loops on opposite ends, the loops being placed over the opposite ends of the fuse to engage the barrel and provide a finger tab for direct pulling of the fuse outwardly from the terminal clips. U.S. Pat. No. 4,288,138 issued Sept. 8, 1981 to E. L. Berry et al shows a fuse puller which is mounted in lateral slides adjacent a fuse clip and which receives one end of the barrel fuse in a slot in the fuse puller. Direct upward movement of the fuse puller within the slides disengages one end of the barrel fuse from its associated clip. U.S. Pat. No. 4,429,936 issued Feb. 7, 1984, to J. J. Rusenko et al and owned by the assignee of this invention, shows a fuse puller for a blade type fuse, the puller being slidably mounted within a slot of the fuse clip. Again, direct upward movement of the fuse puller effects disengagement of the fuse blade from the spring clip terminal. While these devices are all satisfactory for their intended purposes, each have a substantial amount of material extending laterally of the fuse, thereby requiring additional lateral space in the apparatus with which the fuse is utilized. Moreover, each remove the fuse with direct upward movement which requires overcoming considerable spring pressure and friction of the fuse clips.

SUMMARY OF THE INVENTION

This invention provides a fuse puller for a barrel type fuse which is uniquely constructed to minimize the overall dimension in the lateral, or transverse direction of the barrel fuse. Moreover, it provides a fuse puller which provides rotational movement to the fuse upon removal as well as a mechanical advantage to facilitate removal of the fuse from associated clips. The fuse puller of this invention comprises a forwardly projecting post extending along a lateral side of a fuse with which it is associated, a flexible strap attached to the forward end of the post which extends rearwardly along the post and circles the fuse at the rear side thereof and then extends forwardly along an opposite side of the fuse, the strap having a handle at the free end for pulling the strap forwardly, thereby tending to raise and roll the fuse forwardly out of the clip. The fuse puller of this invention, its features and advantages will be more fully understood when reading the following description and claims in conjunction with the accompanying drawings.

DESCRIPTION OF THE PREFERRED EMBODIMENT

Figure 3:
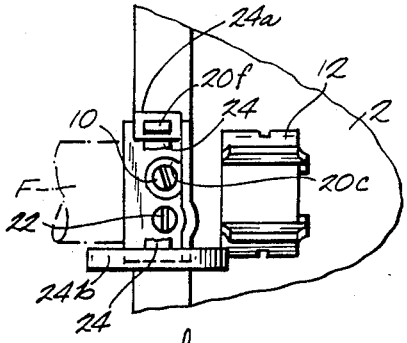
FIG. 3 is a top view of a portion of the device shown in FIG. 1 taken in the direction of the arrows 3—3 in FIG. 1.

An exemplary embodiment of the fuse puller of this invention is shown in the drawings wherein a fragmentary portion of an insulating base 2 for a rotary blade safety or disconnect switch or the like and an insulating terminal block 4 are mounted on a panel or a base of an enclosure 6 by conventional means, not shown. A stationary contact 8 for the switch is mounted to an upper wall of base 2 by a screw 10 (FIG. 3) wherein the contact 8 projects downwardly into a cavity of the switch base 2 for engagement by one end of a movable blade contact (not shown) of the switch. A fuse clip 12 is mounted to an upper surface of contact 8 by conventional means such as a screw (not shown) to project upwardly with respect to the orientation of the figures of the drawing. It is to be understood that electrical apparatus such as disconnect and safety switches and the like which utilize fuses are commonly mounted in a vertical manner such that the axial direction of the fuse is vertical. When so mounted, the direction hereinabove referred to as upward would become a forward direction with respect to the panel or enclosure base 6. The open end of the fuse clip 12 would be oriented forwardly.

A wire lug terminal 14 is mounted to the upper surface of terminal block 4 by a screw 16. Terminal 14 comprises a flat terminal plate which extends along the upper surface of terminal block 4 toward the switch base 2 and which has a fuse clip 18 mounted thereon in a conventional manner such as by a screw (not shown) to arrange the fuse clip 18 in an axially aligned and spaced relation to the fuse clip 12. A barrel type fuse F may be inserted into the fuse clips by aligning its terminal ends with the fuse clips and pressing the fuse downwardly, or rearwardly, into the fuse clips.

The fuse puller of this invention comprises an L-shaped member 20, preferably molded of electrical insulating material, having a vertical leg **20*a* forming an upwardly or forwardly extending post and a lateral leg 20*b* forming a support base. The juncture of vertical leg 20*a* and lateral leg 20*b* is blended by a radius which generally conforms to the radius of the fuse F. Support base 20*b* has a U-shaped transverse cross section, the upright legs of which serve as sides of the member 20 and are blended to the upwardly extending post 20*a* to increase the stability of the post 20*a*. The bottom portion of the U-shaped transverse cross section of support base 20*b* is provided with a pair of holes 20*c* and 20*d*. The support base 20*b* of member 20 is positioned upon the upper surface of a mounting portion of stationary contact 8 such that the hole 20*c* overlies and provides clearance for the head of screw 10 which secures the contact 8 to the switch base 2. The member 20 is secured in this position by a second screw 22 which preferably is a thread cutting screw which passes through the hole 20*d* and threadably engages with an aligned hole in the mounting portion of contact 8 and a hole in the base 2. One vertical side wall of the U-shaped support base 20***b* depends below the base portion to abut against an edge of the switch base 2 to provide non-twisting support for the member 20 about the screw 22.

Figure 4:
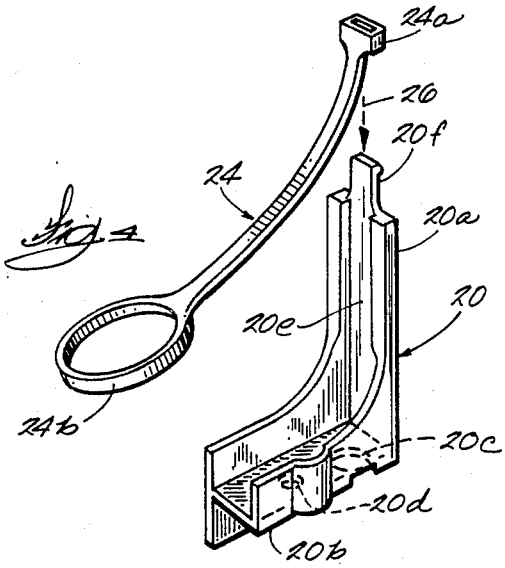
FIG. 4 is an isometric view of the fuse puller of this invention.

As best seen in FIG. 4, upwardly projecting post 20*a* has a groove 20*e* formed therein along the inner surface of the post. The upper end of post 20*a* is provided with an upwardly projecting tab 20*f* having a somewhat enlarged upper end for receiving and securing a collar 24*a* of a flexible strap 24 thereon with a snap fit when attached in the direction of arrow 26 of FIG. 4. The opposite end of strap 24 is provided with a loop 24*b* which serves as a finger engaging grip or tab. Strap 24 projects downwardly or rearwardly along the post 20*a* within the groove 20*e* and then extends laterally along the interior of the U-shaped support base 20*b*. As seen in the drawings, the major transverse cross sectional dimensions of upwardly extending post 20*a* and strap 24 extend in a direction parallel to the axial dimension of the fuse, while the transverse cross sectional dimension of these members in the lateral direction of the fuse is considerably narrower than the aforemention major dimension.

Figure 2:
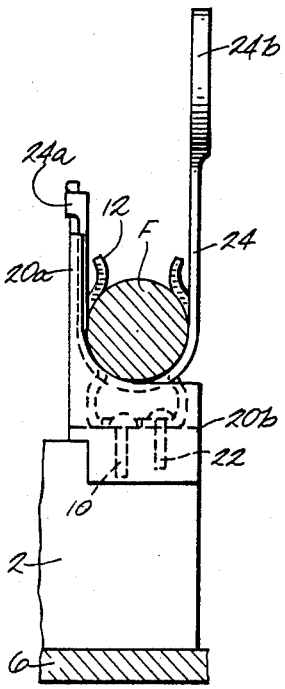
FIG. 2 is a cross sectional view of the device of FIG. 1 taken along the line 2—2 in FIG. 1.
Figure 1:
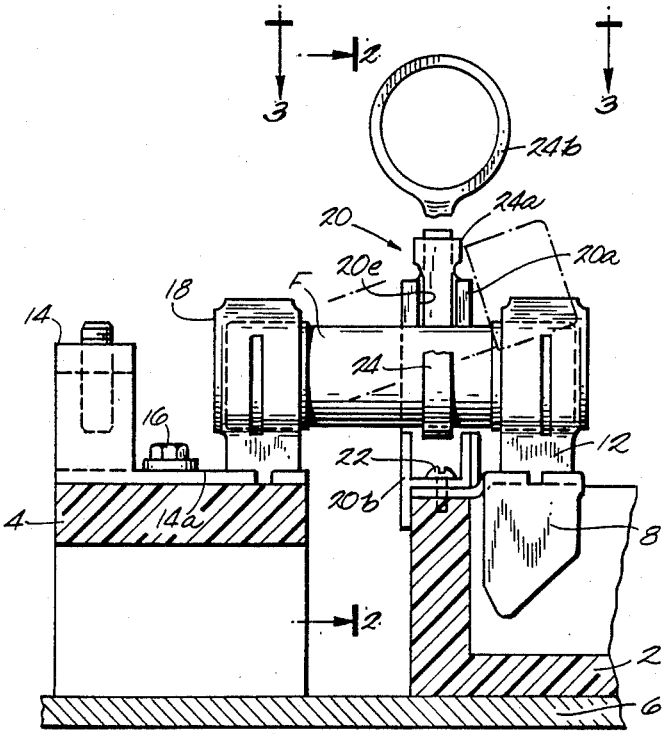
FIG. 1 is a view, partly in cross section, of a portion of a fusible device such as a rotary blade fusible safety switch or the like incorporating the fuse puller of this invention.

As seen in FIGS. 1 and 2, strap 24 underlies the barrel portion of fuse F and the end thereof comprising ring 24*b* extends upwardly or forwardly along an opposite side of the fuse from the post 20*a*. While the strap 24 is formed in a flat shape and would normally project laterally of the fuse along the support base 20*b*, insulating barriers (which have not been shown) between adjacent fused poles of a switch will direct the free end of strap 24 upwardly to the position shown in the drawings. By grasping the ring 24*b* and pulling upwardly on the strap 24, the end of the fuse nearest the fuse puller will roll upwardly and out of the associated spring clip, which as shown in FIG. 1 is spring clip 12, such that the fuse will assume the dotted line position as shown in FIG. 1. By encircling the bottom of the fuse, the strap 24 provides a mechanical advantage such as a pulley which is on the order of a 2:1 ratio. Moreover, the rolling action of the fuse tends to assist the fuse terminal in its motion outwardly of the fuse clip. By keeping the lateral dimensions of the post 20*a* and the strap 24 relatively narrow, the overall lateral width of the fuse and the fuse puller are held to a minimum to enable the fuse puller of this invention to be employed in fused apparatus wherein the pole to pole spacing is marginally narrow.

While the fuse puller of this invention has been shown in a preferred embodiment, it is to be understood that it is susceptible of various modifications without departing from the scope of the appended claims.

We claim:

1. A fuse puller for removing a barrel fuse from a pair of axially aligned, spaced fuse clips comprising:

a post disposed between said clips and being offset laterally to one side of a fuse positioned in said clips, said post projecting forwardly of said fuse;

a flexible strap attached to a forward end of said post, said strap extending rearwardly along said post, encircling a rear side of said fuse and extending forwardly at an opposite lateral side of said fuse; and means on a free end of said strap at said opposite lateral side for gripping said strap for pulling said free end forwardly for rolling at least one end of said fuse out of at least one of said clips.

2. The invention defined in claim 1 wherein said forwardly projecting post is disposed in close lateral proximity to said fuse and has a narrow material thickness in a direction of lateral relationship to said fuse, and said strap has a narrow material thickness in said direction so as to minimize an overall lateral dimension of said fuse, post and strap.

3. The invention defined in claim 2 wherein said post comprises a forwardly extending groove and said strap is disposed in said groove for further minimizing said overall lateral dimension of said fuse, post and strap.

4. The invention defined in claim 1 wherein said post comprises a support base for affixing said post to a supporting structure, said base being offset laterally to extend behind said fuse.

5. The invention defined in claim 4 wherein said post comprises electrically insulating material.

6. The invention defined in claim 5 wherein said strap comprises electrically insulating material.

7. The invention defined in claim 1 wherein said means for gripping said strap comprises a ring for receiving a user's finger.

8. A fuse puller for removing a barrel fuse from a pair of axially aligned, spaced fuse clips comprising:

a flexible strap encircling a rear side of said fuse intermediate said fuse clips, opposite ends of said strap extending forwardly of said fuse at opposite lateral sides thereof;

means fixing one end of said strap forwardly of said fuse; and means on another end of said strap for pulling said other end forwardly to apply a mechanical advantage to said fuse for removing at least one end of said fuse from a respective one of said fuse clips.

* * * * *